US010194689B2

(12) United States Patent
Schennum et al.

(10) Patent No.: US 10,194,689 B2
(45) Date of Patent: Feb. 5, 2019

(54) CONTAINER

(71) Applicant: NICOVENTURES HOLDINGS LIMITED, London (GB)

(72) Inventors: Steven Michael Schennum, Plainfield, IL (US); Thomas Michael McKeon, Wheaton, IL (US); Jeremy Aaron Abel, Oswego, IL (US)

(73) Assignee: NICOVENTURES HOLDINGS LIMITED, London (GB)

( * ) Notice: Subject to any disclaimer, the term of this patent is extended or adjusted under 35 U.S.C. 154(b) by 423 days.

(21) Appl. No.: 14/895,446

(22) PCT Filed: Jun. 3, 2014

(86) PCT No.: PCT/GB2014/051688

§ 371 (c)(1),
(2) Date: Dec. 2, 2015

(87) PCT Pub. No.: WO2014/195688

PCT Pub. Date: Dec. 11, 2014

(65) Prior Publication Data

US 2016/0101909 A1 Apr. 14, 2016

Related U.S. Application Data

(60) Provisional application No. 61/830,924, filed on Jun. 4, 2013.

(51) Int. Cl.
*A24F 15/14* (2006.01)
*A45C 13/00* (2006.01)
(Continued)

(52) U.S. Cl.
CPC ..... *A24F 15/14* (2013.01); *A24F 15/12* (2013.01); *A24F 47/002* (2013.01);
(Continued)

(58) Field of Classification Search
CPC ..... A24F 15/12; A24F 15/14
See application file for complete search history.

(56) References Cited

U.S. PATENT DOCUMENTS 228,598 A 6/1880 Buckley
353,327 A 11/1886 Randolph
(Continued)

FOREIGN PATENT DOCUMENTS

BR 6402132 7/1986
CL 199400288 8/1995
(Continued)

OTHER PUBLICATIONS

International Search Report and Written Opinion of the International Searching Authority, dated Aug. 26, 2014, 9 pages.
(Continued)

*Primary Examiner* — James Harvey
(74) *Attorney, Agent, or Firm* — Patterson Thuente Pedersen, P.A.

(57) ABSTRACT

A container for an electronic nicotine delivery system. The container has a body having a pair of end walls spaced from each other by a base wall and the body also includes a recess extending between the end walls to receive an electronic nicotine delivery system. A lid is pivotally attached to the body for rotation between open and closed positions about an axis parallel to a longitudinal axis of an electronic nicotine delivery system received in the recess.

18 Claims, 10 Drawing Sheets

(51) Int. Cl.

| | |
|---|---|
| ***A24F 15/12*** | (2006.01) |
| ***A24F 47/00*** | (2006.01) |
| ***B65D 25/10*** | (2006.01) |
| ***B65D 43/16*** | (2006.01) |
| ***B65D 43/22*** | (2006.01) |
| ***B65D 85/00*** | (2006.01) |

(52) U.S. Cl.

CPC ..... *A45C 13/007* (2013.01); *B65D 25/10* (2013.01); *B65D 43/16* (2013.01); *B65D 43/22* (2013.01); *B65D 85/70* (2013.01); *A24F 47/008* (2013.01); *A45C 13/00* (2013.01)

(56) References Cited

U.S. PATENT DOCUMENTS 576,653 A 2/1897 Bowlby
595,070 A 12/1897 Oldenbusch
744,074 A 11/1903 Hiering
799,844 A 9/1905 Fuller
885,374 A 4/1908 Pohlig
1,163,183 A 12/1915 Stoll
1,174,406 A * 3/1916 Gillan ..... A24F 15/12 206/251
D53,386 S 5/1919 Thomas
1,436,157 A 11/1922 Fazio
1,512,098 A * 10/1924 Hough ..... A24F 15/12 206/251
1,807,936 A 6/1931 Saunders
1,815,069 A 7/1931 Petro
1,923,560 A * 8/1933 Whittaker ..... A24F 15/12 206/1.5
1,934,629 A * 11/1933 Reilly ..... A24F 15/12 206/256
1,937,120 A 11/1933 Lagerholm
1,937,987 A 12/1933 Sexton
2,262,318 A 11/1941 Fox
2,411,946 A 12/1946 Vogel
2,467,923 A 4/1949 Allen
2,483,304 A 9/1949 Vogel
2,513,672 A * 7/1950 Pino ..... A24F 15/14 206/38
2,522,952 A 9/1950 Krohn
2,544,501 A * 3/1951 Johnson ..... A24F 15/14 221/260
2,658,368 A 11/1953 Siegel
2,782,910 A 2/1957 Keibow
3,165,225 A 1/1965 Reitzel
3,722,742 A 3/1973 Wertz
3,743,136 A 7/1973 Chambers
3,861,523 A 1/1975 Fountain
3,863,803 A 2/1975 Valcic
4,190,412 A 2/1980 Tokai
4,214,658 A 7/1980 Crow
D279,508 S 7/1985 Bauer et al.
4,733,794 A 3/1988 Kent
4,753,383 A 6/1988 Focke
4,793,478 A 12/1988 Tudor
4,923,059 A 5/1990 Evers
4,961,438 A 10/1990 Korte
5,044,550 A 9/1991 Lamm
D322,687 S 12/1991 Tschudin
D346,878 S 5/1994 Gee et al.
5,353,956 A 10/1994 Wilson
5,448,317 A 9/1995 Tamway
D392,069 S 3/1998 Rowland
D404,201 S 1/1999 Wennerstrom
5,896,984 A 4/1999 Focke
5,938,017 A 8/1999 Wik
D414,892 S 10/1999 Chen
5,967,312 A 10/1999 Jacobs
5,996,783 A * 12/1999 Herchelroth ..... A24F 19/0064 206/245
D432,263 S 10/2000 Abdullah
D434,217 S 11/2000 Packard
D434,979 S 12/2000 Liu
D436,725 S 1/2001 Rogers
D438,003 S 2/2001 Minagawa
D441,133 S 4/2001 Emery
D449,521 S 10/2001 Pinkus et al.
6,321,757 B1 11/2001 McCutcheon
6,446,793 B1 9/2002 Layshock
D466,012 S 11/2002 Baker
D470,765 S 2/2003 Baker
D471,804 S 3/2003 Staples
D472,012 S 3/2003 South
6,530,495 B1 3/2003 Joseph
6,561,391 B1 5/2003 Baker
6,715,605 B1 4/2004 Manservigi
6,726,006 B1 4/2004 Funderburk
6,736,143 B2 5/2004 Rennecampe
D493,617 S 8/2004 Armato
D509,732 S 9/2005 Staples
D545,186 S 6/2007 Liebe
D549,573 S 8/2007 Liebe
D550,455 S 9/2007 Barnhart
D566,329 S 4/2008 Bagaric et al.
D566,890 S 4/2008 Bagaric et al.
7,389,878 B1 6/2008 Torrico
D573,889 S 7/2008 Short
D575,451 S 8/2008 Jones
7,455,176 B2 11/2008 Focke
7,565,969 B2 7/2009 Wen-Tan
D606,854 S 12/2009 Greenhalgh
D610,983 S 3/2010 Wai
D611,806 S 3/2010 Bried
D613,903 S 4/2010 Wu
D613,904 S 4/2010 Wu
D616,753 S 6/2010 Beam
D628,469 S 12/2010 Taylor
D631,838 S 2/2011 Cheng
D636,257 S 4/2011 Bougoulas
D649,658 S 11/2011 Belfrance
D650,738 S 12/2011 Leung
8,113,343 B2 2/2012 Aakerlind
D656,094 S 3/2012 Wu
D661,016 S 5/2012 Borges
D671,677 S 11/2012 Wu
D671,678 S 11/2012 Wu
8,307,834 B1 11/2012 Palmerino
D672,642 S 12/2012 Supranowicz
D674,539 S 1/2013 Wu
8,448,783 B2 5/2013 Vecchi
D693,055 S 10/2013 Manca et al.
8,602,210 B2 12/2013 Milner
D700,397 S 2/2014 Manca et al.
8,794,245 B1 8/2014 Scatterday
D715,760 S 10/2014 Kim et al.
D716,267 S 10/2014 Kim et al.
8,910,783 B2 12/2014 Liu
D720,884 S 1/2015 Liu
D723,738 S 3/2015 Liu
D736,460 S 8/2015 McKeon et al.
D737,507 S 8/2015 Liu
2004/0056651 A1 3/2004 Daniele
2005/0087460 A1 4/2005 Bruhm
2005/0224375 A1 10/2005 Focke
2007/0193895 A1 8/2007 Weiss
2007/0267032 A1 11/2007 Shan
2008/0083627 A1 4/2008 Hamm
2008/0223382 A1 9/2008 Zeanah
2009/0223841 A1* 9/2009 Mack, Jr. ..... A24F 15/14 206/242
2009/0266837 A1 10/2009 Gelardi
2009/0288966 A1 11/2009 Minarelli
2010/0313901 A1 12/2010 Fernando
2011/0011396 A1 1/2011 Fang
2011/0180433 A1 7/2011 Rennecampe
2011/0226236 A1 9/2011 Buchberger
2011/0303231 A1 12/2011 Li et al.
2012/0103842 A1* 5/2012 Koester ..... A24F 17/00 206/273
2012/0145169 A1 6/2012 Wu
2012/0199146 A1 8/2012 Marangos

(56) References Cited

U.S. PATENT DOCUMENTS

| | | | | |
|---|---|---|---|---|
| 2012/0227752 | A1 | 9/2012 | Alelov | |
| 2012/0227753 | A1 | 9/2012 | Newton | |
| 2013/0098786 | A1 | 4/2013 | Collins | |
| 2013/0192615 | A1 | 8/2013 | Tucker | |
| 2013/0284192 | A1 | 10/2013 | Peleg | |
| 2013/0340779 | A1 | 12/2013 | Liu | |
| 2013/0341218 | A1 | 12/2013 | Liu | |
| 2013/0342157 | A1 | 12/2013 | Liu | |
| 2014/0007892 | A1 | 1/2014 | Liu | |
| 2014/0020697 | A1 | 1/2014 | Liu | |
| 2014/0060528 | A1 | 3/2014 | Liu | |
| 2014/0060555 | A1 | 3/2014 | Chang | |
| 2014/0196731 | A1 | 7/2014 | Scatterday | |
| 2014/0209105 | A1 | 7/2014 | Sears | |
| 2014/0238423 | A1 | 8/2014 | Tucker | |
| 2014/0238424 | A1 | 8/2014 | Macko | |
| 2014/0261490 | A1 | 9/2014 | Kane | |
| 2014/0270730 | A1 | 9/2014 | DePiano | |
| 2016/0101909 | A1* | 4/2016 | Schennum ..... | A45C 13/007 206/266 |
| 2016/0106155 | A1 | 4/2016 | Reevell | |
| 2016/0120218 | A1 | 5/2016 | Schennum et al. | |

FOREIGN PATENT DOCUMENTS

| | | | |
|---|---|---|---|
| CN | 1329567 | A | 1/2002 |
| CN | 2485265 | Y | 4/2002 |
| CN | 2660914 | Y | 12/2004 |
| CN | 2904674 | Y | 5/2007 |
| CN | 101115901 | A | 1/2008 |
| CN | 201023852 | Y | 2/2008 |
| CN | 201240612 | Y | 5/2009 |
| CN | 201370099 | Y | 12/2009 |
| CN | 201430913 | Y | 3/2010 |
| CN | 201592850 | U | 9/2010 |
| CN | 101878958 | A | 11/2010 |
| CN | 201657770 | U | 12/2010 |
| CN | 201830900 | U | 5/2011 |
| CN | 102264420 | A | 11/2011 |
| CN | 202122096 | | 1/2012 |
| CN | 201860753 | U | 6/2012 |
| DE | 594585 | | 3/1934 |
| DE | 2940797 | | 4/1981 |
| DE | 2940797 | A1 | 4/1981 |
| DE | 202013100606 | | 2/2013 |
| DE | 202013100606 | U1 | 2/2013 |
| EP | 1820748 | A1 | 8/2007 |
| EP | 225233 | A1 | 11/2010 |
| FR | 472030 | A | 11/1914 |
| FR | 1292446 | | 5/1962 |
| FR | 1292446 | A | 5/1962 |
| GB | 190930472 | | 12/1909 |
| GB | 191100628 | A | 11/1911 |
| GB | 191311086 | A | 9/1913 |
| GB | 110216 | | 10/1917 |
| GB | 110216 | A | 10/1917 |
| GB | 111454 | | 11/1917 |
| GB | 120 016 | A | 10/1918 |
| GB | 160493 | A | 3/1921 |
| GB | 163124 | | 5/1921 |
| GB | 163124 | A | 5/1921 |
| GB | 215992 | | 5/1924 |
| GB | 215992 | A | 5/1924 |
| GB | 220229 | A | 8/1924 |
| GB | 268967 | | 4/1927 |
| GB | 402064 | | 11/1933 |
| GB | 507955 | | 6/1939 |
| GB | 544329 | | 4/1942 |
| GB | 565574 | | 11/1944 |
| GB | 611596 | | 11/1948 |
| GB | 626888 | | 7/1949 |
| GB | 626888 | A | 7/1949 |
| GB | 871869 | | 7/1961 |
| GB | 1046183 | | 7/1988 |
| GB | 2275464 | | 8/1994 |
| GB | 2068034 | | 11/1997 |
| GB | 2369108 | | 5/2002 |
| GB | 2369108 | A | 5/2002 |
| GB | 4000273 | | 12/2006 |
| GB | 4006615 | | 10/2008 |
| HK | 1193081 | | 1/2016 |
| JP | S5289386 | U | 7/1977 |
| JP | S57-140354 | | 8/1982 |
| JP | 3093201 | U | 4/2003 |
| JP | 2005-013092 | | 1/2005 |
| JP | 2005-138773 | | 6/2005 |
| JP | 2007-297124 | | 11/2007 |
| JP | 2009-526714 | | 7/2009 |
| JP | 2011-087569 | A | 5/2011 |
| NL | 6617184 | | 6/1967 |
| RU | 94815 | U1 | 6/2010 |
| RU | 121706 | U1 | 11/2012 |
| UA | 78167 | U | 3/2013 |
| WO | WO2002060769 | | 8/2002 |
| WO | WO2007060395 | A1 | 5/2007 |
| WO | WO2008006048 | | 1/2008 |
| WO | WO2008104870 | | 9/2008 |
| WO | WO2009019217 | A1 | 2/2009 |
| WO | WO2009092419 | A2 | 7/2009 |
| WO | WO2011137453 | A2 | 11/2011 |
| WO | WO2012065754 | | 5/2012 |
| WO | WO2012065754 | A2 | 5/2012 |
| WO | WO2012114082 | | 8/2012 |
| WO | WO2013045942 | | 4/2013 |
| WO | WO2013116558 | | 8/2013 |
| WO | WO2013142671 | | 9/2013 |
| WO | WO2013189050 | | 12/2013 |
| WO | WO2013189052 | | 12/2013 |
| WO | WO2014005275 | | 1/2014 |
| WO | WO2014015463 | | 1/2014 |

OTHER PUBLICATIONS

Application and File History for U.S. Appl. No. 14/888,517, filed Nov. 2, 2015, inventor Reevell.

Application and File History for U.S. Appl. No. 14/895,599, filed Dec. 3, 2015, inventors Schennum et al.

Application and File History for Design U.S. Appl. No. 29/475,565, filed Dec. 4, 2013, inventors McKeon et al.

International Search Report and Written Opinion for International Application No. PCT/GB2014/051332 dated Jul. 21, 2014.

Office Action dated Sep. 3, 2014, for Russian Application No. 2013504605. English Translation Provided.

International Preliminary Report on Patentability and Written Opinion dated Nov. 12, 2015 for International Application No. PCT/GB2014/4839051332.

International Preliminary Report on Patentability for International Application No. PCT/GB2014/051688 dated Dec. 8, 2015.

International Report on Patentability, Application No. PCT/GB2014/051688, dated Dec. 17, 2015, 6 pages.

Chinese Office Action, Application No. 201480031296.1, dated Mar. 27, 2017, 8 pages.

Chinese Office Action, Application No. 201480031296.1, dated Nov. 29, 2017, 9 pages (15 pages with translation).

Great Britain Office Action, Application No. GB1405720.2, dated Mar. 1, 2017, 4 pages.

Japanese Office Action, Application No. 2016-517671, dated Feb. 21, 2017, 3 pages.

Russian Decision to Grant, Application No. 2015146845, dated Apr. 27, 2017, 10 pages.

Japanese Search Report, Application No. 2016-517671, dated Feb. 15, 2017, 13 pages.

Chinese Office Action, Application No. 201480031926.5 , dated Apr. 21, 2017, 7 pages.

Chinese Office Action, Application No. 201480024978.X, dated Jan. 18, 2017, 5 pages.

International Report on Patentability, Application No. PCT/GB2014/051332, dated Nov. 12, 2015, 6 pages.

(56) References Cited

OTHER PUBLICATIONS

International Search Report and Written Opinion of the International Searching Authority, International Application No. PCT/GB2014/051633, dated Apr. 12, 2014, 19 pages.
Notification of transmittal of the International Preliminary report on Patentability, International Application No. PCT/GB2014/051633, dated Oct. 23, 2015, 10 pages.
Chilean Office Action, Application No. 201503537, dated Mar. 21, 2018, 7 pages.

* cited by examiner

CONTAINER

RELATED APPLICATIONS

The present application is a National Phase entry of PCT Application No. PCT/GB2014/051688, filed Jun. 3, 2014, which claims the benefit of U.S. Application No. 61/830,924, filed Jun. 4, 2013, each of which is incorporated herein by reference in its entirety.

TECHNICAL FIELD

Embodiments are related to containers for electronic nicotine delivery systems, particularly but not exclusively to a container for an electronic cigarette.

BACKGROUND

Electronic nicotine delivery systems are typically cigarette-sized and function by allowing a user to inhale a nicotine vapor from a liquid store by applying a suction force to a mouthpiece. Electronic nicotine delivery systems include electronic cigarettes.

SUMMARY

In accordance with embodiments, there is provided a container for an electronic nicotine delivery system, the container comprising a body having a pair of end walls spaced from each other by a base wall, the body including a recess extending between the end walls to receive an electronic nicotine delivery system and a lid pivotally attached to the body for rotation between open and closed positions about an axis parallel to a longitudinal axis of an electronic nicotine delivery system received in said recess.

The body may include a compartment between the recess and the lid axis, the body and the lid being configured so that an electronic nicotine delivery system is retained in the recess when the lid is in its closed position with the lid covering the recess and said compartment.

The container may further comprise a biasing member to bias the lid towards an open position.

The container may further comprise a locking mechanism to hold the lid in the closed position.

The locking mechanism may comprise a cooperating protrusion on the lid and a receiving part on a front edge of the body, said protrusion being received in said receiving part to lock the lid in the closed position.

The container may comprise a hinge mechanism that pivotally mounts the lid to the body, the hinge mechanism being configured so that the lid can slide laterally in a direction parallel to the base wall of the body to disengage the protrusion from the receiving part and allow the lid to pivot into its open position.

The hinge mechanism may comprise an elongate slot in the lid and a hinge pin that extends from the body and into said slot to pivotally mount the lid to the body and allow the lid to slide laterally relative to the hinge pin received in said slot.

The container may comprise a hinge mechanism that includes a cam element captured between the body and the lid and constrained to move within a groove formed in the body and a track formed in said lid, said track defining a stable position for the cam element so that the lid is held in a closed position by the cam element when said cam element is in said stable position, and an unstable position in which the lid is free to pivot into its open position when released, said cam element being movable out of said stable position into said unstable position in response to rotation of the lid in a direction towards the body from its closed position.

The track may comprise an endless loop in the lid and the cam element moves from its stable position along a first portion of the track when the lid pivots into its open position and along a second portion of the track back to its stable position when the lid is pivoted back into its closed position.

The track may be configured so that the cam element moves back into said stable position when the lid is rotated towards the body beyond its closed position so that the lid is held in its closed position when the lid is released.

The container may comprise a tray received in said body, said recess being formed in said tray.

The compartment may also be formed by said tray.

The tray may be an insert that locates within the chamber and is pivotally mounted to the body for rotation about an axis coaxial with the lid.

The tray may be shaped so that said compartment is disposed between the tray and the base wall of the body, said compartment being accessible when said tray has been rotated about said axis.

The lid and the tray may be configured so that the lid engages the tray during rotation of said lid so that the tray rotates about said axis together with the lid for part of the rotation of the lid between its open and closed positions.

The container may have an electronic nicotine delivery system received in the recess in the body.

The electronic nicotine delivery system may be an electronic cigarette.

BRIEF DESCRIPTION OF THE DRAWINGS

Embodiments will now be described, by way of example only, with reference to the accompanying drawings, in which.

DETAILED DESCRIPTION

Figure 1A:
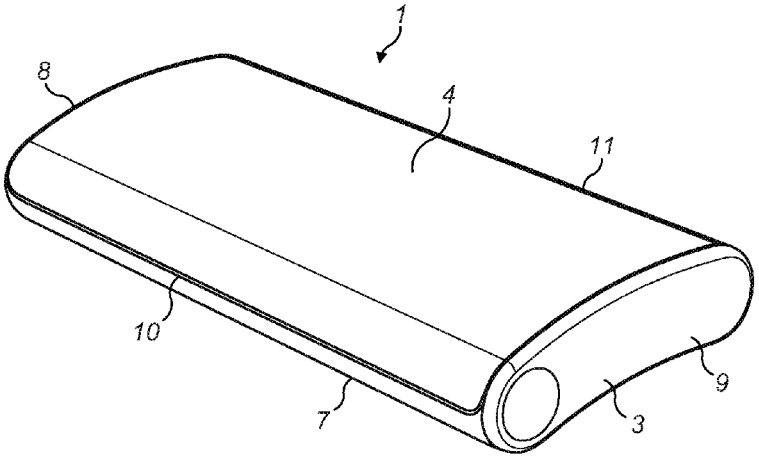
FIG. 1*a* shows an example of a container for an electronic cigarette, with a lid in a closed position.
Figure 1B:
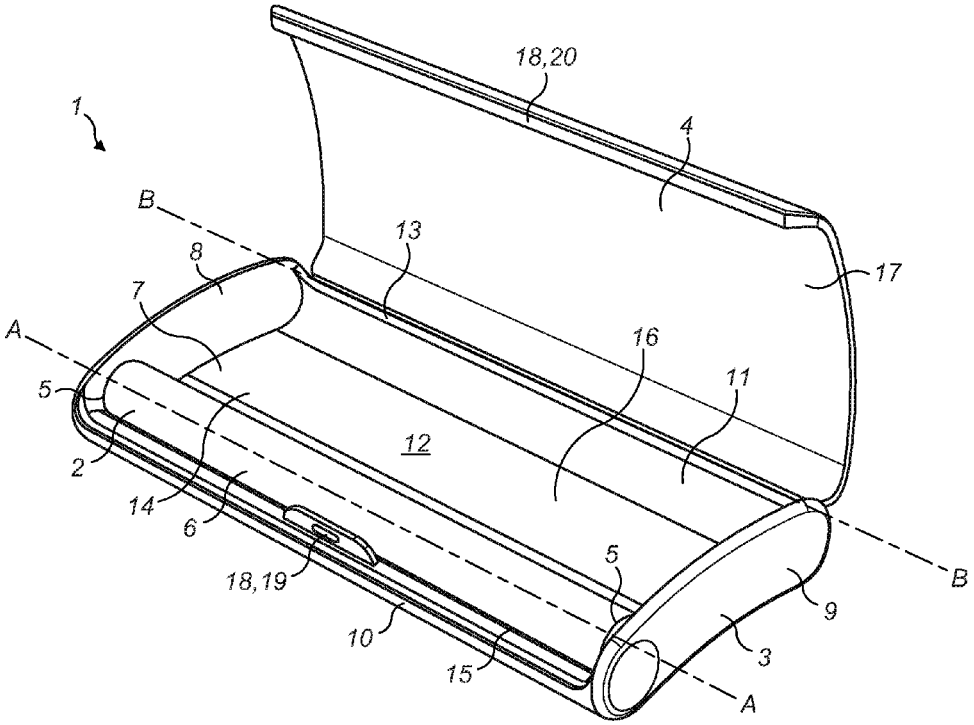
FIG. 1*b* shows the container of FIG. 1*a*, with the lid in an open position.

FIGS. 1*a* and 1*b* show a container 1 for an electronic nicotine delivery system having a body 3 and a pivotally attached lid 4. The container 1 is intended to hold an elongate electronic nicotine delivery system, such as an electronic cigarette 2, as shown in FIG. 1*b*.

Electronic cigarettes have a size and shape, which is similar to conventional cigarettes, and generally have an elongate body having a longitudinal axis A-A. As shown in FIG. 1*b*, an electronic cigarette 2 will have two ends 5 and an elongate side surface 6. The electronic cigarette may have a constant cylindrical shape so that the elongate side surface 6 is a rounded surface. However, it will be appreciated that other electronic nicotine delivery systems and some electronic cigarettes may have an alternative shape and embodiments are not limited to cylindrical or constant size electronic nicotine delivery systems. For example, an electronic cigarette may have a stepped side, with a change in diameter along its length. Alternatively, an electronic cigarette may have a tapered shape or may have a triangular, square or any other cross-sectional shape, and it will be appreciated that that which is defined in the claims may be used for such products.

As shown in FIGS. 1*a* and 1*b*, the container 1 has an elongate body 3 formed of a base wall 7, opposing end walls 8, 9 and opposing side walls 10, 11. The body 3 is elongate such that the base wall 7 is longer in the direction of the side walls 10, 11 than in the direction of the end walls 8, 9. The side walls 10, 11 extend from the longer edges of the base wall 7 in a direction generally perpendicular to the plane of the base wall 7 and the opposing end walls 8, 9 extend from the shorter edges of the base wall 7 in a similar manner. Therefore, the base wall 7, side walls 8, 9 and end walls 10, 11 define a chamber 12 within the body, as shown in FIG. 1*b*, which is open via an open side of the body 3 which is opposite the base wall 7. As shown in FIGS. 1*a* and 1*b*, any of the end walls 8, 9, side walls 10, 11 or edges between the walls of the container 1 may be rounded to provide the container 1 with a rounded or smoothed exterior and therefore make the container 1 easier for a user to hold, carry, use and easier to insert into and retrieve from a pocket.

For example, as shown in FIG. 1*a*, the container 1 may have a generally kidney bean shaped cross-section with the base wall 7 and an opposing side having a curved profile. This shape may make it easier for a user to hold and use the container and makes the container more comfortable to place into a pocket.

The side walls 10, 11 and end walls 8, 9 extend from the base wall 7 to define a shallow and elongate chamber 12. This gives the body 3 and the container 1 a substantially flat construction within which the chamber 12 is defined.

The open side of the container 1, opposite to the base wall 7, provides access to the chamber 12. The lid 4 is pivotally attached along a side wall 11 of the body 3 to cover the open side of the body 3 and is openable to provide access to the chamber 12. As shown in FIG. 1*b*, the lid 4 is attached to the body 3 by means of a hinge 13 located along a side wall 11 of the body 3. The hinge 13 may be mounted to the side wall 11 or to the opposing end walls 8, 9 such that the rotational axis B-B of the lid 4 extends in a direction along a side wall 11 of the container 1. As shown in FIG. 1*a*, when the lid 4 is closed the open side of the body 3 is covered and the chamber 12 is closed. FIG. 1*b* shows the lid 4 in an open position which allows a user to access the chamber 12 for inserting or retrieving an electronic cigarette 2 within the chamber 12.

As shown in FIG. 1*b*, the container 1 also has a tray 14 disposed within the chamber 12. The tray 14 extends at least partially across the chamber 12 and may be formed integrally with the body 3, as a part of the base wall 7, or the tray 14 may be formed as an insert which is received within the chamber 12. In this example, the tray 14 extends across the entire chamber 12, covering the base wall 7 of the body 3. The tray 14 has a recessed region 15 which is configured to receive an electronic cigarette 2. In particular, the recessed region 15 is formed as a partly cylindrical recess in the tray 14 that receives an electronic cigarette 2 and supports the electronic cigarette 2 within the chamber 12. As shown in FIG. 1*b*, for a circular cylindrical electronic cigarette 2, the recessed region 15 may be semi-circular.

As shown in FIG. 1*b*, the recessed region 15 of the tray 14 is formed in a direction parallel to the elongate side walls 10, 11 of the body 3 such that the longitudinal axis A-A of the electronic cigarette 2 is parallel to the side walls 10, 11 of the body 3 and therefore also parallel to the rotational axis B-B of the hinge 13 between the body 3 and the lid 4. The electronic cigarette 2 is supported by the tray 14 on its elongate side face 6. The electronic cigarette 2 can be inserted into and removed from the tray 14 via the open side of the body 3 when the lid 4 is open.

In this example, the tray 14 received within the chamber 12 also has a compartment 16 which is formed adjacent to the recessed region 15 and is provided to receive an ancillary article (not shown), such as a leaflet or a replacement part for the electronic cigarette 2. As shown in the example of FIG. 1*b*, the compartment 16 may also comprise a recessed region that occupies the remaining space within the chamber 12.

The example of FIG. 1*b* shows a tray 14 having a recessed region 15 for an electronic cigarette 2 which is disposed against a front side wall 10 of the body 3, opposite to the side wall 11 to which the hinge 13 is mounted. In this example, the compartment 16 is disposed between the recessed region 15 and the side wall 11 to which the hinge 13 is mounted. However, it will be appreciated that the recessed region 15 and the compartment 16 may be arranged differently within the chamber 12. For example, the recessed region 15 may be disposed against the side wall 11 of the body 3 to which the hinge 13 is mounted, with the compartment 16 occupying the remaining space within the chamber 12. Alternatively, the recessed region 15 may be disposed centrally within the chamber 12, spaced from each side wall 10, 11 of the body 3. In this case, the compartment 16 may be divided into two regions disposed on either side of the recessed region 15.

It will be appreciated that the semi-cylindrical recessed region 15 shown in the example of FIG. 1*b* is provided for the constant size cylindrical electronic cigarette 2 shown in this example. However, the shape of the recessed region 15 may be altered to suit the electronic cigarette 2 or other type of electronic nicotine delivery system which the tray 14, and the container 1, is configured to receive. For example, the recessed region 15 may comprise a step which changes the size of the recessed region 15 so that the tray 14 is suitable to receive a matching electronic cigarette 2. Alternatively, the recessed region 15 may not be semi-cylindrical and may instead have a triangular or square shape appropriate to receive an electronic nicotine delivery system having a different shape.

When the lid 4 is in a closed position, an inner face 17 of the lid 4 may act to retain the electronic cigarette 2 within the recessed region 15. That is, the electronic cigarette 2 is supported on one side by the tray 14 and when the lid 4 is closed the lid 4 acts to prevent the electronic cigarette 2 from coming out of the recessed region 15 of the tray 14. The inner surface 17 of the lid 4, when closed, may contact the electronic cigarette 2 and thereby hold the electronic cigarette 2 in the recessed region 15. Alternatively, the inner surface 17 of the lid 4, when closed, may be disposed a small distance away from the side surface 6 of the electronic cigarette 2 so that the electronic cigarette 2 is not able to come out of the recessed region 15. Alternatively, the lid 4 may comprise a member (not shown) that extends from the internal surface 7 of the lid 4 to retain the electronic cigarette 2 in the recessed region 15 and such a member may be a solid member or it may be a deformable foam pad. Alternatively, the lid 4 may comprise an additional recess (not shown) which is aligned with the recessed region 15 of the tray 14 when the lid 4 is closed, so that an electronic cigarette 2 received in the container 1 is supported between two opposing recesses when the lid 4 is closed.

As shown in FIG. 1*b*, the length of the body 3 of the container 1, in particular the length of the chamber 12 and the recessed region 15 within the tray 14, is slightly greater than the length of an electronic cigarette 2. In this way, when an electronic cigarette 2 is received in the chamber 12 there is limited space between each end 5 of the electronic cigarette and the end walls 8, 9 of the body 3 for movement of the electronic cigarette 2 in an axial direction.

As explained above, the example container 1 shown in FIGS. 1*a* and 1*b* supports the electronic cigarette 2 within the recessed region 15 and the lid 4 when the lid 4 is closed. When the lid 4 is open, the electronic cigarette 2 is presented to the user and can easily be gripped and removed from the recessed region 15 in the tray 14 by a user. While in the container 1, the electronic cigarette 2 is prevented from moving around significantly and is thereby protected from movement and damage during transportation.

The container 1 may be made from a rigid material, for example a polymer such as polycarbonate, or a metal, such as tin or aluminum. The rigid container 1 will protect the contents from impact, crushing and bending forces and may also provide some protection against dirt and liquids.

The body 3 and/or the lid 4 may be made from an opaque, translucent or transparent polymer material, so that a user may be able to see the contents of the container 1 when it is closed.

As shown in FIG. 1*b*, the example container 1 may have a locking mechanism 18 that acts to hold the lid 4 in a closed position and which a user can release to allow the lid 4 to be opened. The locking mechanism 18 is formed of two parts; the side wall 10 of the body 3 has a protrusion 19 and the side edge of the lid 4 has a receiving part 20. When the lid 4 is closed, the protrusion 19 and receiving part 20 engage to hold the lid 4 in a closed position. A user is able to lift the receiving part 20 away from the protrusion 19 to release the locking mechanism 18, allowing the lid 4 to be pivotally opened.

The lid 4 is able to rotate between a closed position, in which the open side of the body 3 is covered, and an open position, in which the chamber 12 is exposed. A maximum open position of the lid 4 may be defined by a part of the lid 4 which contacts a part of the body 3 to prevent further rotation in the open direction. Alternatively, the hinge 13 may be configured to have a maximum opening angle.

Figure 2:
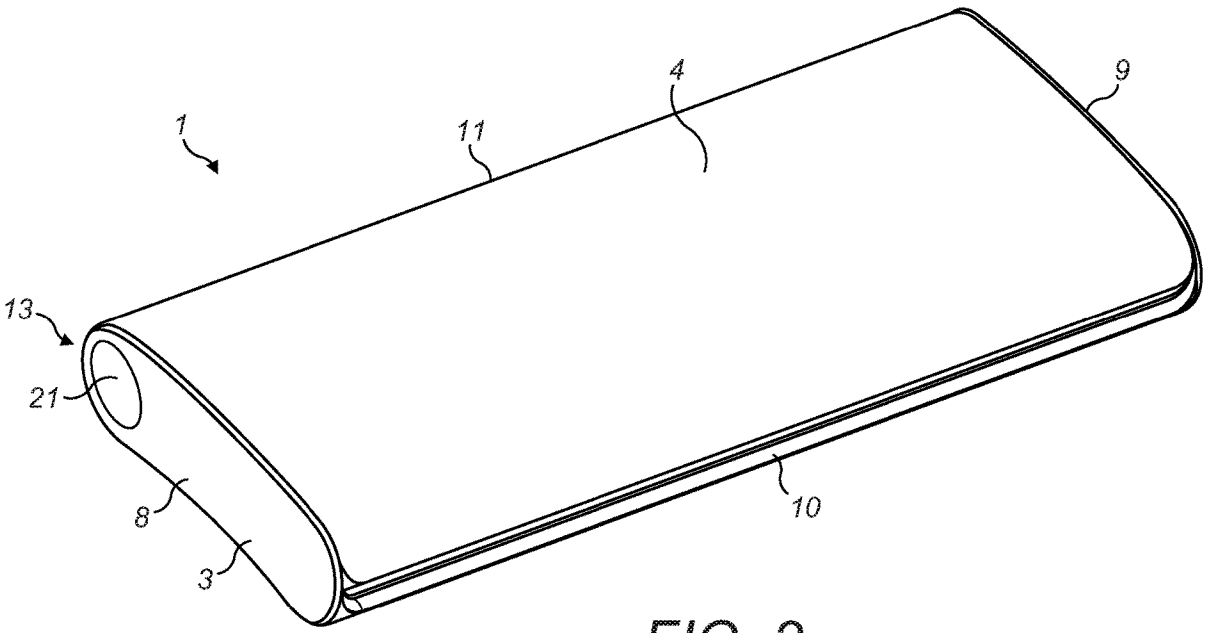
FIG. 2 shows an example of a container for an electronic cigarette, with the lid in a closed position.

FIG. 2 shows another example of a container 1 for an electronic cigarette, having a body 3 and a pivotally mounted lid 4 which are similar to those described with reference to FIGS. 1*a* and 1*b*. In this example, the hinge 13 between the body 3 and the lid 4 comprises a pin 21 that extends through the end walls 8, 9 of the body 3, a part of the lid 4 and optionally a part of the side wall 11 of the body 3. The side wall 11 of the body 3, along which the hinge 13 extends, may have a cut out that allows a part of the lid 4 to extend around the edge of the container 1 and also allows the lid 4 to rotate into the open position. The pin 21 of the hinge 13 may comprise a single pin 21 that extends along the container 1, or alternatively comprise two pins, one extending through each side wall 8, 9.

The hinge 13 may be provided with a biasing member (not shown), such as a torsion spring, compression spring, extension spring or other resilient member that urges the lid 4 towards the open position. The container 1 may also have a locking mechanism (not shown) which holds the lid 4 in the closed position until a user releases the locking mechanism and allows the lid 4 to rotate into the open position. The locking mechanism will act between the lid 4 and the body 3 and may be positioned on the side wall 10 of the body 3, and corresponding edge of the lid 4, on an opposite side of the container to the hinge 13. Alternatively, the locking mechanism may be located on the end walls 8, 9 of the body 3 or may be integrally formed within the hinge 13 itself. The locking mechanism retains the lid 4 in the closed position, against the force of the biasing member, until a user disengages the locking mechanism at which point the lid 4 is rotated into the open position by the biasing member.

Figure 3A:
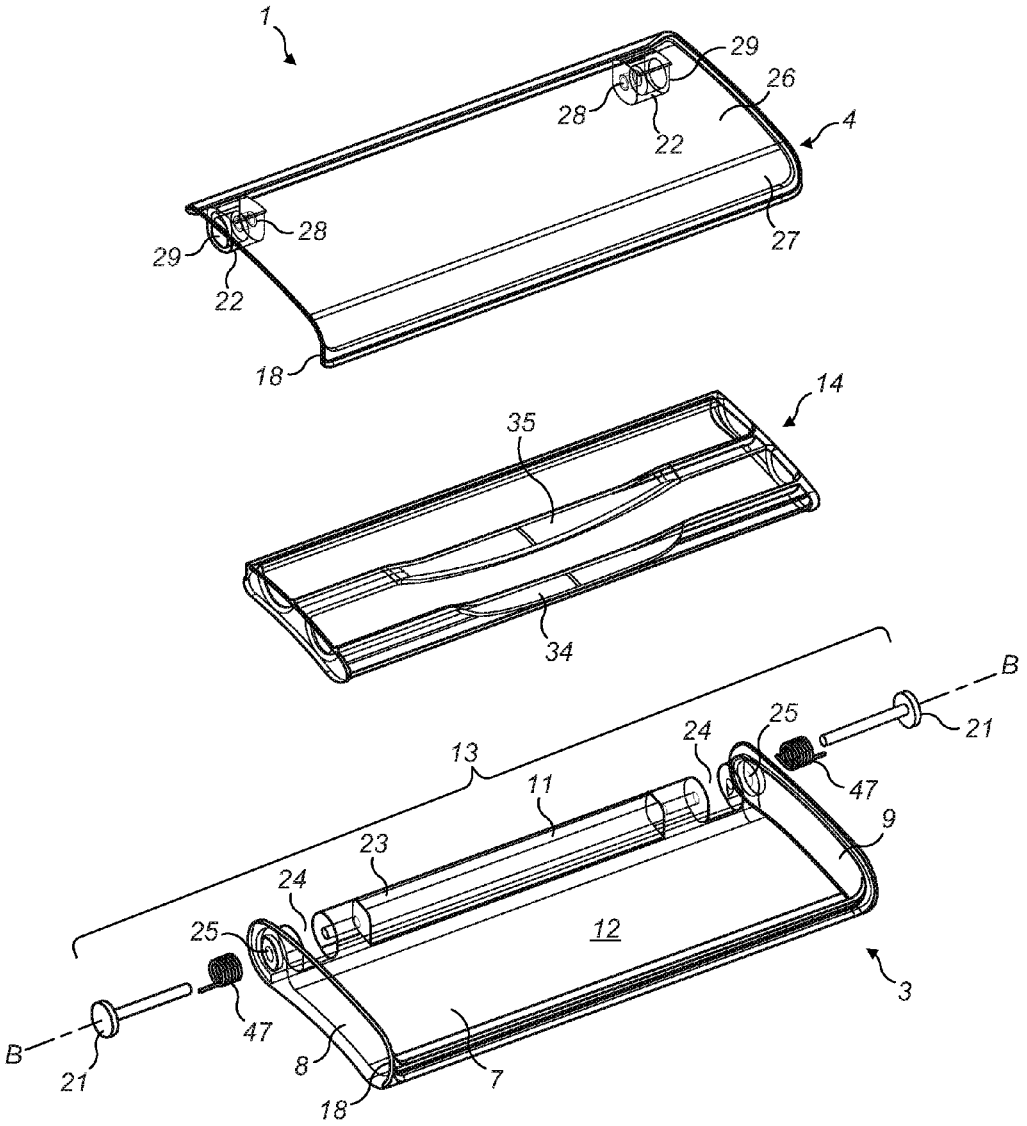
FIG. 3*a* shows an exploded assembly view of an example of a container for an electronic cigarette.

FIG. 3*a* shows a detailed exploded assembly drawing of an example container 1 which has a construction similar to that described with reference to FIG. 2. In this case, the hinge 13 is formed by a pin 21 extending through each end wall 8, 9 of the body 3, and into two spaced hinge members 22 which extend from the lid 4. In the example shown in FIG. 3*a*, the pin 21 also extends into the side wall 11 of the body which in this example is formed of a hinge mounting protrusion that extends along the edge of the body 3 between the hinge members 22 of the lid 4. However, it will be appreciated that the pin 21 may not extend into the side wall 11 of the body 3, so long as the pin 21 pivotally connects a part of the body 3 to a part of the lid 4.

As shown in FIG. 3*a*, the hinge 13 also includes a biasing member 47 to urge the lid 4 into an open position. In this example, the biasing member 47 is a torsion spring, but may alternatively be a compression spring or extension spring arranged to urge the lid 4 to rotate into the open position, or any other resilient member.

In this example, the container 1 has a locking mechanism 18 that is configured to hold the lid 4 in the closed position until the lid 4 is moved in a plane parallel to the base wall 7 of the body 3 to disengage the locking mechanism 18 and allow the lid 4 to rotate under the force of the biasing member 47. That is, to open the container 1, the lid 4 must be moved a small amount in a direction perpendicular to the rotational axis A-A to disengage the holding locking mechanism 18, as explained in more detail below with reference to FIGS. 3*b* and 3*c*.

As shown in FIG. 3*a*, the side wall 11 of the body 3 to which the hinge 13 is mounted comprises a hinge mounting protrusion 23 that extends along the edge of the base wall 7 and has two spaced recesses 24 which are positioned close to the end walls 8, 9 to receive the hinge members 22 of the lid 4. The hinge mounting protrusion 23 forms the side wall 11 of the container and also provides surfaces for the mounting of the hinge. That is, the hinge mounting protrusion 23 comprises end faces at either end of a protrusion that extends along the edge of the base wall 7 to form the side wall 11, such that the end faces are perpendicular to the direction of the side wall 11 and parallel with the end walls 8, 9 of the container and form one side of the hinge mounting recesses 24. An aperture 25 extends through the end walls 8, 9 and optionally partially into each end of the hinge mounting protrusion 23 of the side wall 11, between the two recesses 24, to receive the two pins 21—one from each end of the container.

The lid 4, as shown in FIG. 3*a*, has a generally planar top wall 26 and a curved front edge 27 so that it matches the shape of the open side of the body 3 and closes the chamber 12 when attached to the body 3. The two spaced hinge members 22 extend from the lid 4 into the spaced recesses 24 in the side wall 11 of the body 3. Each hinge member 22 comprises an aperture 28 that is aligned with the apertures 25 extending through the end walls 8, 9 and the hinge mounting protrusion 23 of the side wall 11 of the body 3 so that the pin 21 can extend through the end walls 8, 9 and hinge members 22 of the lid 4 to pivotally mount the lid 4 to the body 3 about a rotational axis B-B that is parallel to the side wall 11 of the container 1.

The hinge members 22 extending from the lid 4 are formed of a generally cylindrical protrusion which is aligned with the rotational axis B-B of the hinge 13. Each hinge member 22 comprises an aperture 28 through which the pin 21 extends and one side of each hinge member 22 has a recess 29 that is coaxial with the aperture 28 to receive the biasing member 47. That is, a biasing member 47 is disposed in the recess 29 in each hinge member 22 and the pin 21 extends through the hinge member 22 and through the middle of the biasing member 47. In this example, the recess 29 for the biasing member 47 is disposed on a side of the hinge members 22 that faces towards the end walls 8, 9 of the body 3. However, it will be appreciated that the recesses 29 for the biasing members 47 may alternatively be disposed on the inner sides of the hinge members 22. Alternatively, the recesses 29 may be formed in additional components which are positioned between the hinge members 22 and a part of the body 3.

Each hinge member 22 also comprises an anchor (not shown), which may be a hole or a groove or a recess in which a first end of the biasing member 47 is received, or alternatively a protrusion against which an end of the biasing member 47 abuts. The second end of the biasing member is received within a second anchor provided on the side wall 11 of the body 3.

In this way, the first end of each biasing member 47 is anchored to the lid 4 and the second end of each biasing member 47 is anchored to the body 3, while the pins 21 provide a pivotal relationship, so that the lid 4 is pivotally mounted to the body 3 and the biasing members 47 urge the lid 4 to rotate about the pins 21 towards an open position.

As shown in FIG. 3*a*, the apertures 28 in the hinge members 22 of the lid 4 are formed as elongate slots. The apertures 28 are elongated in a direction parallel to the plane of the top wall 26 of the lid 4, which is parallel to the base wall 7 of the body 3 when the lid 4 is closed. Therefore, the lid 4 is pivotally mounted through rotation about the pins 21, and also slidably mounted through movement of the lid 4 along the slotted apertures 28. The slotted apertures 28 are configured such that when the lid 4 is positioned with the pins 21 at a first end of the slotted apertures 28, the locking mechanism 18 is engaged and the lid 4 is locked in a closed position, with the front edge of the lid 4 aligned with the front edge of the body 3 to close the chamber 12. When the lid 4 is slidably moved in a lateral direction, so that the pins 21 are positioned at the second end of the slotted apertures 28, the front edge of the lid 4 has moved away from the front edge of the body 3 in a direction away from the hinge 13, which causes the locking mechanism to disengage and allows the lid 4 to rotate into the open position under the force of the biasing member 47.

Figure 3B:
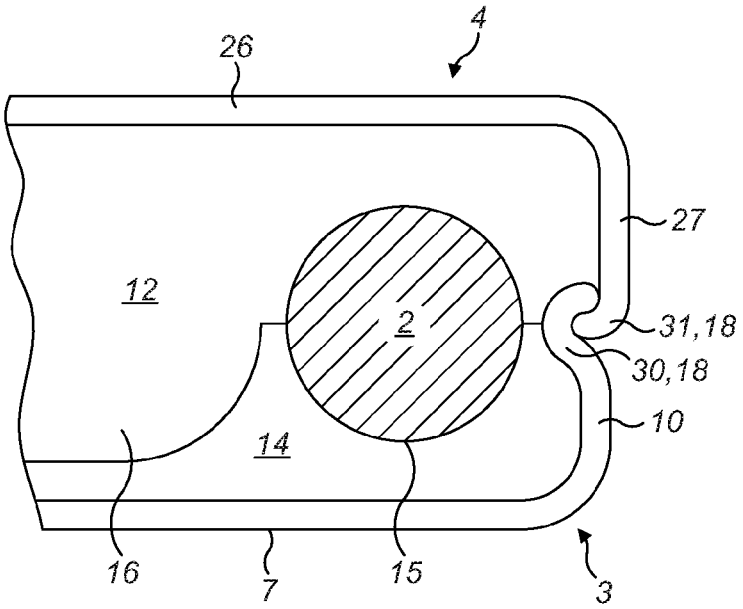
FIGS. 3*b* and 3*c* show cross-sectional views of the container of FIG. 3*a*, with an electronic cigarette received within the container.

FIG. 3*b* shows a cross-sectional view of the container 1 of FIG. 3*a*, taken across one of the end walls 8, 9 of the container 1. As shown in FIG. 3*b*, when the lid 4 is in a closed position, the locking mechanism 18 is engaged and a first locking part 30 on the side of the body 3 which is opposite to the hinge (see FIG. 3*a*), engages with a second locking part 31 on the front edge 27 of the lid 4 to lock the lid 4 and prevent rotation relative to the body 3. In this example, the first locking part 30 comprises a protrusion and the second locking part 31 comprises a recess. The protrusion 30 and the recess 31 engage each other to providing a holding force that locks the lid 4 in a closed position. However, it will be appreciated that the first and second locking parts 30, 31 may be formed in any shape that is able to engage together and provide the holding force.

Figure 3C:
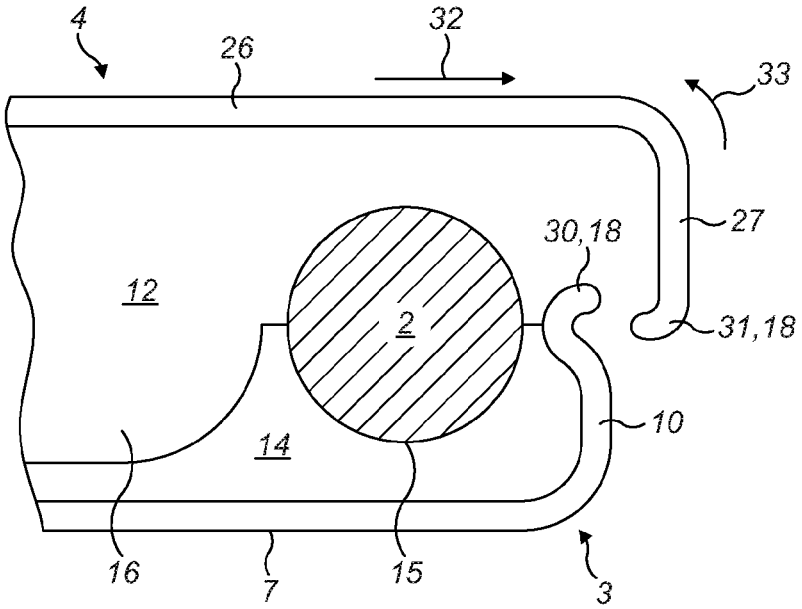

As shown in FIG. 3*c*, when the lid 4 is slidably moved in a lateral direction along the slotted apertures (28, see FIG. 3*a*), in the direction of the arrow 32, the first and second locking parts 30, 31 are moved away from each other and the lid 4 is released allowing it to rotate in the direction of arrow 33, into the open position.

In this example, the first and second locking parts 30, 31 of the locking mechanism 18 are formed in the front edge of the body 3 and the lid 4 respectively. However, it will be appreciated that the locking mechanism 18 comprising the first and second locking parts 30, 31 may be provided in any position along the front edge 27 of the body 3 and the lid 4. For example, the first and second locking parts 30, 31 may extend along the entire front edge of the body 3 and the lid 4. For example, the first and second locking parts 30, 31 may be formed in a central part of the front edge 27 of the lid 4, or in any other position between the lid 4 and the body 3. In another example, the second locking part 31 may be formed in each end wall 8, 9 of the body 3 and in each end of the front edge 27 of the lid 4. In any case, the first and second locking parts 30, 31 will engage when the lid 4 is in a closed position.

As shown in FIG. 3*a* and as previously explained, the side wall 11 of the body 3 to which the hinge 13 is mounted is formed of a generally cylindrical hinge mounting protrusion 23 that extends along the side wall 11 of the body 3. The hinge members 22 of the lid 4 are also formed as generally cylindrical protrusions. The cylindrical side wall 23 and hinge members 22 are configured to match each other such that when the lid 4 is mounted to the body 3 the exterior of the container 1 is smooth and continuous. Furthermore, when the lid 4 is rotated into the open position, the exterior of the container 1 remains continuous because the cylindrical shape of the side wall 11 of the body 3 and the hinge members 22 of the lid are matching and also aligned with the rotational axis B-B of the hinge 13. However, it will be appreciated that the hinge members 22 of the lid 4 and the side wall 11 of the body 3 may have other shapes.

The tray 14 which supports the electronic cigarette 2 and ancillary article is also shown in FIGS. 3*a*, 3*b* and 3*c*. In this example, the tray 14 is formed as an insert which is received within the chamber 12 of the body 3. As shown in FIGS. 3*b* and 3*c*, in this example, the insert 14 comprises a first recessed region 15 to receive and support an electronic cigarette 2 and a compartment 16 to receive an ancillary article (not shown). As shown in FIG. 3*a*, the tray 14 may also comprise two further recesses 34, 35, extending partly along the recessed region 15 and compartment 16 to allow a user to more easily grasp an electronic cigarette or ancillary article received in the tray 14. These recesses 34, 35 may be positioned centrally, as shown in FIG. 3*a*. Alternatively, they may be positioned anywhere in the tray 14 along the recessed region 15 and/or the compartment 16.

Figure 4:
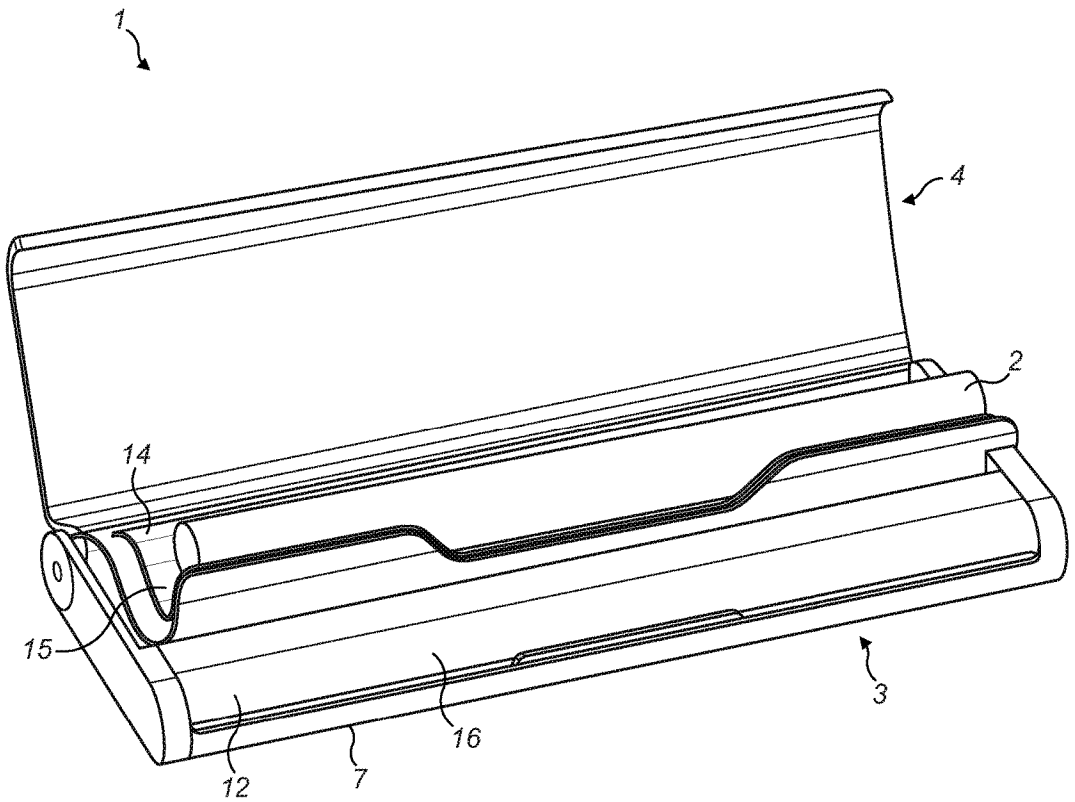
FIG. 4 shows an example of a container for an electronic cigarette, with the lid in an open position.

FIG. 4 shows another example of a container 1 for an electronic cigarette 2, having a body 3 and a pivotally mounted lid 4 similar to the container 1 described with reference to FIGS. 1*a* and 1*b*. In this example, the tray 14 within the chamber 12 is an insert which is pivotally mounted to the body 3 and coupled to the lid 4 so that as the lid 4 is rotated into an open position the tray 14 is partially rotated into a lifted position, as shown. The tray 14 rotates by a smaller amount than the lid 4, so that tray 14 is lifted to a position intermediate the base wall 7 of the body 3 and the lid 4 when the lid 4 is in an open position. Therefore, the electronic cigarette 2 received on the tray 14 is presented to the user and the space between the tray 14 and the base wall 7, within the chamber 12, becomes accessible to the user. In this example, the tray 14 is provided with a first recessed region 15 on the top of the tray 14 for the electronic cigarette 2 and the compartment 16 is provided beneath the tray 14, and becomes accessible when the tray 14 is partially rotated on opening of the lid 4.

Figure 5:
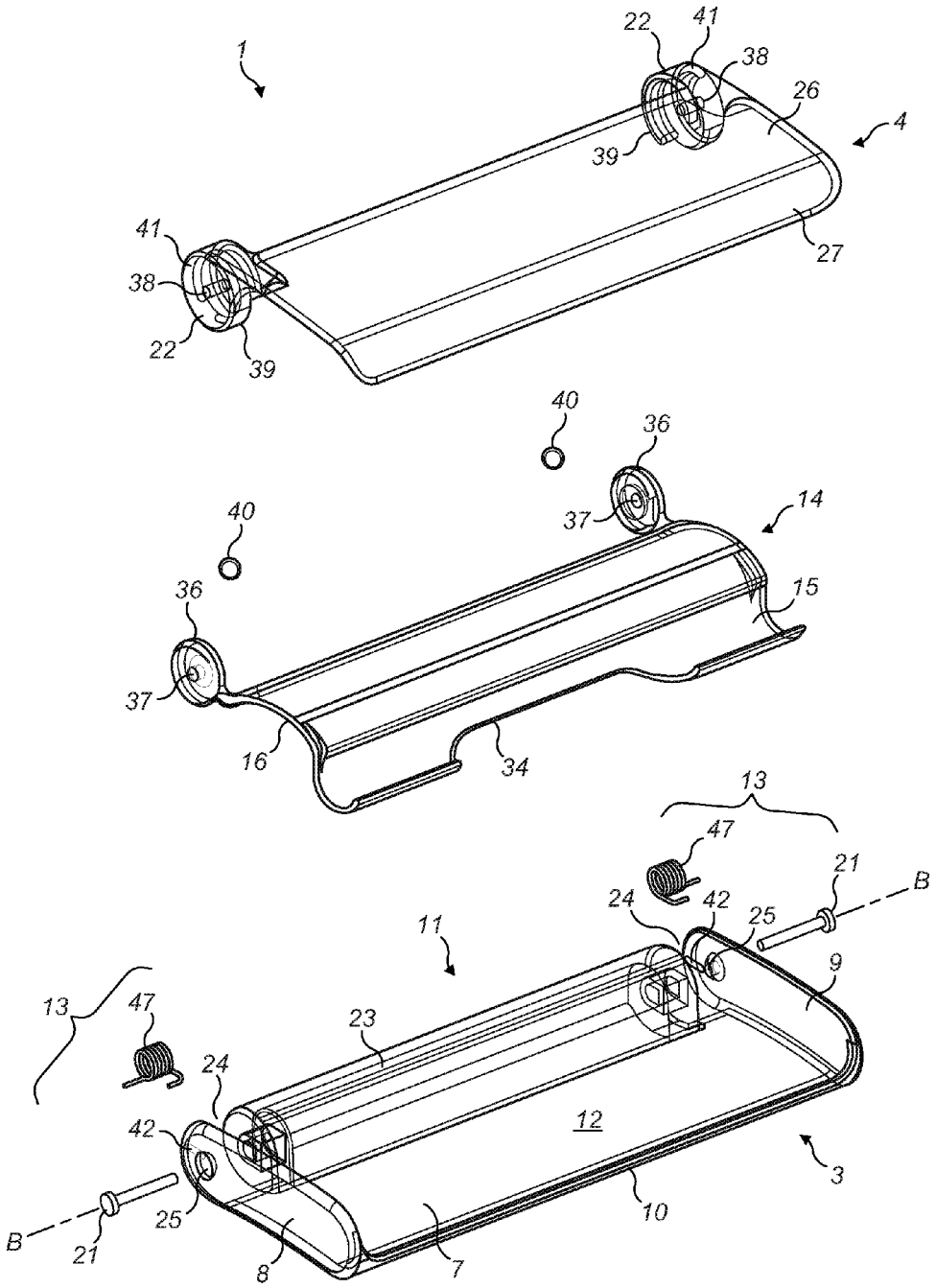
FIG. 5 shows an exploded assembly view of the container of FIG. 4.

FIG. 5 shows a detailed exploded assembly view of the container 1 of FIG. 4. In this example, as explained above, the tray 14 is pivotally mounted to the body 3 and coupled to the lid 4 so that as the lid 4 is opened the tray 14 is partially rotated within the chamber 12.

As shown in FIG. 5, the tray 14 of this example is provided with a first recessed region 15 to receive an electronic cigarette and a compartment 16, on a side of the tray 14 opposite to the first recessed region 15, to receive an ancillary article between the tray 14 and the base wall 7 of the body 3, as described with reference to FIG. 4. Therefore, the compartment 16 is only accessible when the tray 14 has been lifted into the position shown in FIG. 4. In this example, the tray 14 is provided with a recess 34, such that an electronic cigarette can easily be removed from the recessed region 15 in the tray 14.

FIG. 5 also shows the components of the hinge 13 of this example container 1. The hinge 13 of this example container has a biasing member 47 that urges the lid 4 to rotate into the open position shown in FIG. 4. The biasing member 47 may be a torsion spring, as shown in FIG. 5, or may alternatively be a compression spring or extension spring arranged to urge the lid into an open position or may be any other resilient member. The hinge 13 of this example container 1 has a locking mechanism that locks the lid 4 in a closed position until a user applies a downward force on the lid 4, which releases the locking mechanism and allows the lid 4 to rotate to the open position under the force of the biasing member 47. The lid 4 is closeable by rotating the lid 4 back into the closed position and applying a further downward force to engage the locking mechanism.

The side wall 11 of the body 3 to which the hinge 13 is mounted comprises a hinge mounting protrusion 23 that extends along the side wall 11 and has two spaced recesses 24 to receive the hinge members 22 of the lid 4. The hinge mounting protrusion 23 forms the side wall 11 of the container and also provides surfaces for the mounting of the hinge 13. That is, the hinge mounting protrusion 23 comprises end faces at either end of a protrusion that extends along the edge of the base wall 7 to form the side wall 11, such that the end faces are perpendicular to the direction of the side wall 11 and parallel with the end walls 8, 9 of the container and form one side of the hinge mounting recesses 24. The hinge members 22 of the lid 4 extend from the lid 4 into the spaced recesses 24 formed in the side wall 11 of the body 3 in a similar manner to that described with reference to FIG. 3*a*. The tray 14 also comprises two hinge members 36 that extend into the spaced recesses 24 in the side wall 11 of the body 3 so that the hinge members 22 of the lid 4 and the hinge members 36 of the tray 14 are adjacent to each other in the spaced recesses 24. Each of the hinge members 22, 36 has an aperture 38, 37 that is aligned with apertures 25 in the end walls 8, 9 of the body 3 so that a pin 21 can extend through each end wall 8, 9 and through the hinge members 22, 36 to pivotally mount the lid 4 and tray 14 to the body 3. The apertures 25 formed in the end walls 8, 9 of the body may extend into the side wall protrusion 23 of the body 3 to receive the ends of the pins 21. In this example, the hinge members 36 of the tray 14 are disposed on an inner side, between the hinge members 22 of the lid 4. However, it will be appreciated that the arrangement of the hinge members 22, 36 within the spaced recesses 24 in the side wall 11 of the body 3 may be different.

The biasing means 47 are received in a recess formed in the hinge mounting protrusion 23 of the side wall 11 of the body and are anchored to both the side wall 11 of the body and the hinge members 22 of the lid 4 in a similar manner to the example container described with reference to FIG. 3*a*.

The two hinge members 22 of the lid 4 each comprise a circular protrusion that extends from the lid 4 and are coaxially aligned with the rotational axis B-B of the lid 4. Each hinge member 22 of the lid 4 has a protrusion in the form of a circumferential shoulder 39 that extends from the hinge member 22, partially around the circumference of the hinge member 22, towards the hinge member 36 of the tray 14. This shoulder 39 is disposed to contact the tray 14 as the lid 4 is pivoted open and to push the tray 14 such that it pivots into the open position shown in FIG. 4. In particular, as the lid 4 is rotated from the closed position towards the open position it will rotate independently of the tray 14 for a predetermined angle until the shoulders 39 of the hinge members 22 of the lid 4 engage with the tray 14, after which further rotation of the lid 4 will cause the tray 14 to rotate with the lid 4. In this way, the tray 14 is rotatably coupled to the lid 4 so that when the lid 4 is opened the tray 14 is rotated to the intermediate position shown in FIG. 4. In this example, each hinge member 22 of the lid 4 has a shoulder 39. However, it will be appreciated that only one of the hinge members 22 may be provided with a shoulder 39 to contact and rotate the tray 14.

It will be appreciated that the rotating tray described with reference to FIGS. 4 and 5 may be provided to any of the containers 1 described with reference to any of the other Figures.

The hinge 13 of the example container shown in FIG. 5 also has a locking mechanism which can be engaged to lock the lid 4 in the closed position and can be disengaged to allow the lid 4 to rotate into the open position. The locking mechanism is disengaged by depressing and releasing the lid 4 to allow the lid to rotate to the open position. The locking mechanism can then be re-engaged by rotating the lid to the closed position and depressing the lid 4 further before releasing the lid 4. This is explained in more detail with reference to FIGS. 6*a* to 8*b* below.

As shown in FIG. 5, the hinge 13 is formed of two parts, one on each side of the container 1, and each hinge comprises a locking mechanism. However, it will be appreciated that only one locking mechanism may be required in which case only one part of the hinge may be provided with a locking mechanism. Each locking mechanism has a cam element 40 which is disposed between the hinge member 22 of the lid 4 and the end wall 8, 9 of the body 3, in a track 41 formed in the hinge member 22 and a groove 42 formed in the end wall 8, 9, as explained in detail below with reference to FIGS. 6*a* to 8*b*.

Figure 6A:
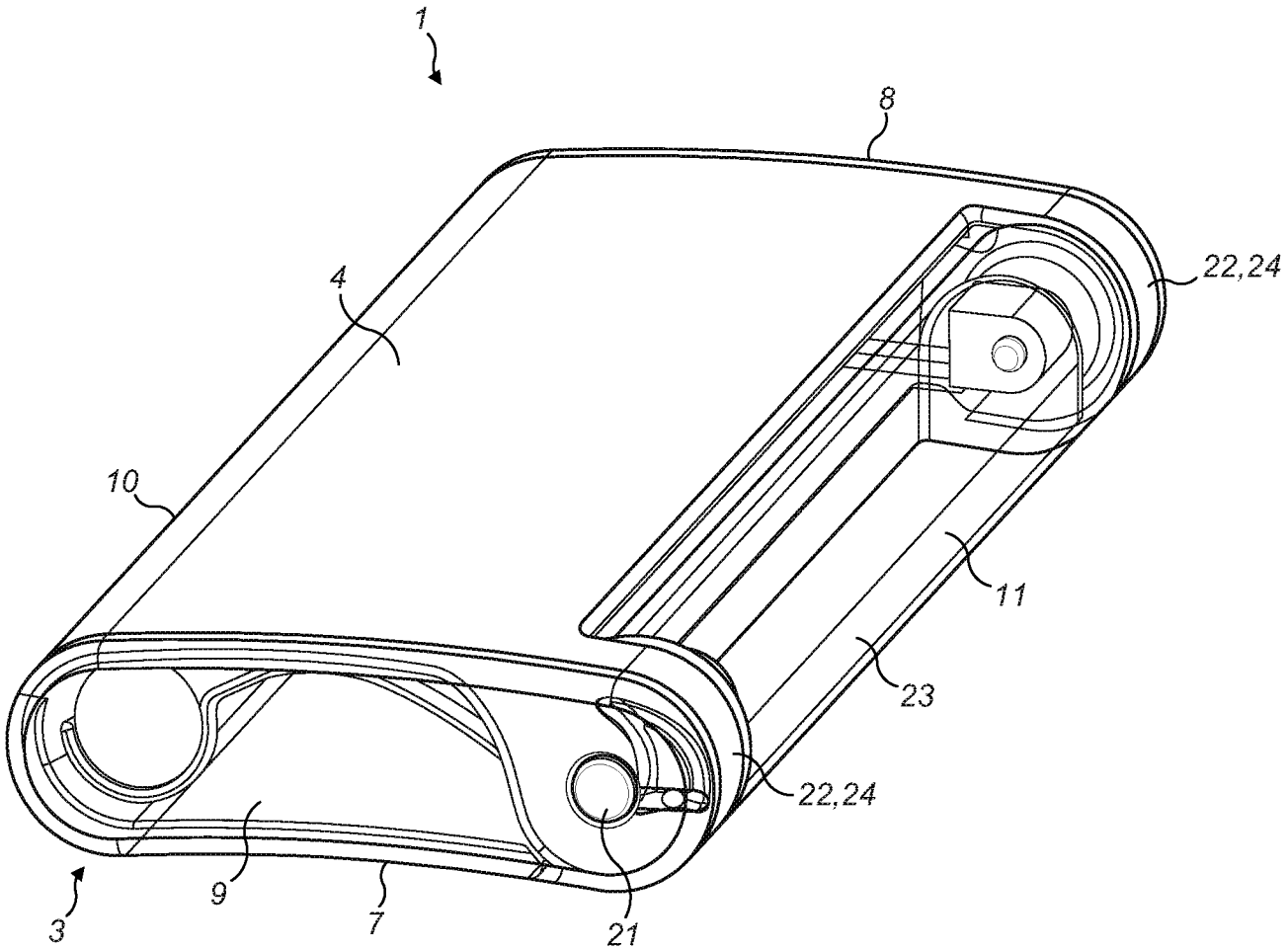
FIG. 6*a* shows an isometric view of the container of FIGS. 4 and 5.

FIG. 6*a* shows the container 1 of FIGS. 4 and 5 with the lid 4 in a closed position, covering the open side of the body 3 and enclosing the chamber. As shown, the hinge members 22 of the lid 4 are received in the spaced recesses 24 of the side wall 11 of the body 3, between the end walls 8, 9 and the hinge mounting protrusion 23 of the side wall 11, and a hinge pin 21 extends through each end wall 8, 9 and the hinge members 22 and into the hinge mounting protrusion 23 to pivotally mount the lid 4 to the body 3. In the closed position, the lid 4 is in a stable position with the lid 4 being flush with the end walls 8, 9 and side walls 10, 11 of the body 3.

Figure 6B:
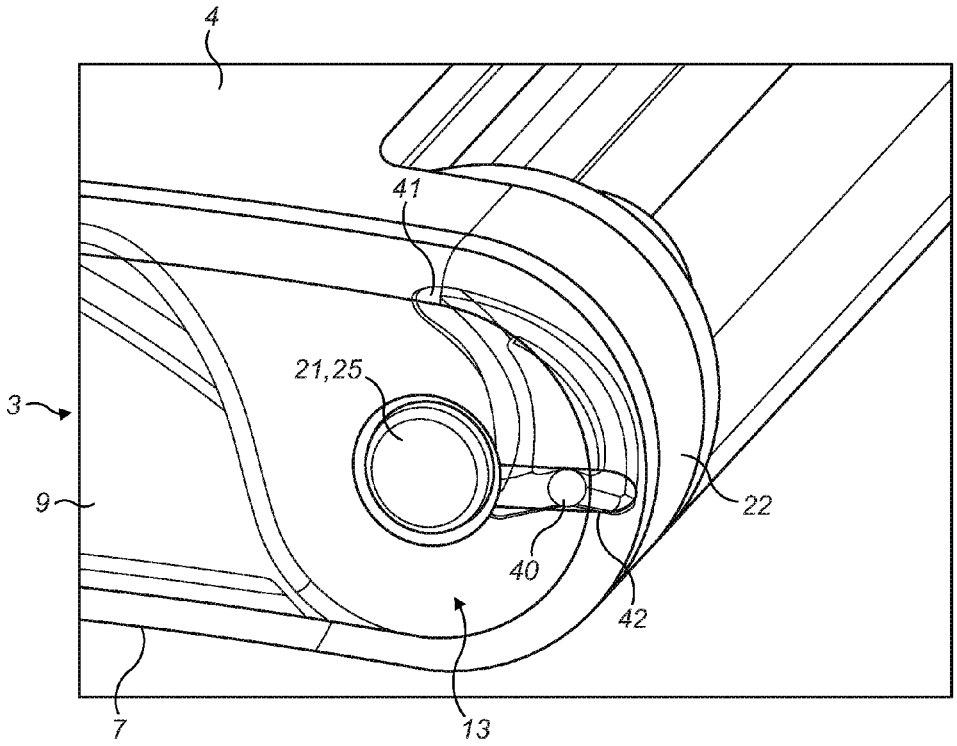
FIG. 6*b* shows a detailed view of the hinge of the container of FIGS. 4 to 6*a*, with the lid in a closed position.

FIG. 6*b* shows an enlarged view of the hinge 13 of the container 1 of FIG. 6*a*, with the components of the container 1 shown as translucent so that internal components are visible. As shown, the end wall 9 of the body 3 comprises a groove 42 which extends from the hinge aperture 25 away from the pin 21, towards the side wall 11 of the body 3 in a direction parallel to the base wall 7 of the body 3. The hinge member 22 of the lid 4, which is disposed adjacent to the end wall 9, comprises a track 41 which includes three portions, as shown in FIG. 6*c*: a first portion 43 having a bend 46; a second portion 44 which extends from an end of the first portion 43, circumferentially around the hinge member 22 co-axially with the rotational axis B-B (see FIG. 5) of the hinge 13; and a third portion 45 which extends between the second portion 44 and the first portion 43 in a curved manner with a circumference which is the same as the second portion 44 of the track 41, but disposed at a different angle.

In this way, the track 41 is a closed loop and defines a fixed loop path for the cam element 40 which is retained in the track 41 and the groove 42, between the end wall 9 of the body 3 and the hinge member 22 of the lid 4, during rotation of the lid 4. The track 41 defines an endless path around which the cam element 40 is moved. In this example, the cam element is a ball bearing 40 that is moved around the track 41 during rotation of the lid 4. However, it will be appreciated that the ball bearing may be replaced with another suitable element that is capable of being moved around the track to lock and unlock the lid 4 in the manner described below.

Figure 6C:
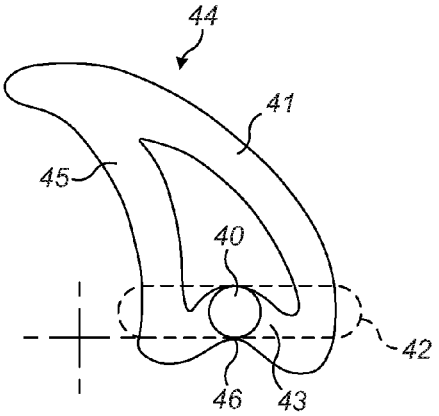
FIG. 6*c* shows the ball and track of the hinge of the container of FIGS. 4 to 6*b*.

As shown in FIGS. 6*b* and 6*c*, when the lid 4 is in a closed position the ball bearing 40 is disposed in the bend 46 of the first portion 43 of the track 41 in the hinge member 22 and in an intermediate part of the groove 42 in the end wall 9. The first portion 43 of the track 41 and the groove 42 are arranged in the hinge 13 such that when the lid 4 is in the closed position, with the biasing member (47, See FIG. 6) urging the lid towards the open position, the groove 42, track 41 and ball bearing 40 combine to cause the ball bearing 40 to be urged into the bend 46 of the first portion 43 of the track 41. Therefore, the ball bearing 40 is urged into a stable position, where the biasing member holds the ball bearing 40 in the bend 46 and prevents movement of the lid 4. A force is required to move the ball bearing 40 along the first portion 43 of the track 41 and out of the bend 46, to allow the lid 4 to open.

Figure 7A:
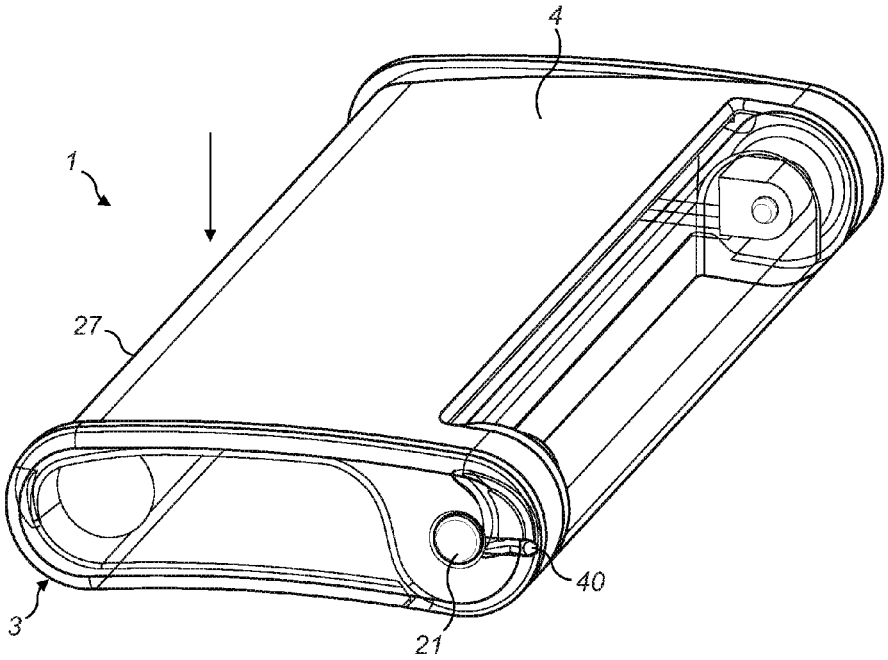
FIG. 7*a* shows the container of FIGS. 4 to 6*c*, with the lid in a depressed position during opening.

FIG. 7*a* shows the container 1 described with reference to FIGS. 5 to 6*c* with the lid 4 in a depressed position, which causes the locking mechanism to disengage and allows the lid 4 to open. This is the position to which the lid 4 must be moved by a user to move the ball bearing 40 from the stable position in the bend 46 of the track 41, as shown in FIG. 6*b*, to an unstable position which allows the ball bearing 40 to move around the second portion 44 of the track 41 and thereby allow the lid 4 to rotate to the open position under influence of the biasing member. In particular, a user must depress the lid 4 by pushing down on the lid 4 so that the front edge 27 of the lid 4 rotates towards the base wall 7 of the body 3, as shown in FIG. 7*a*.

Figure 7B:
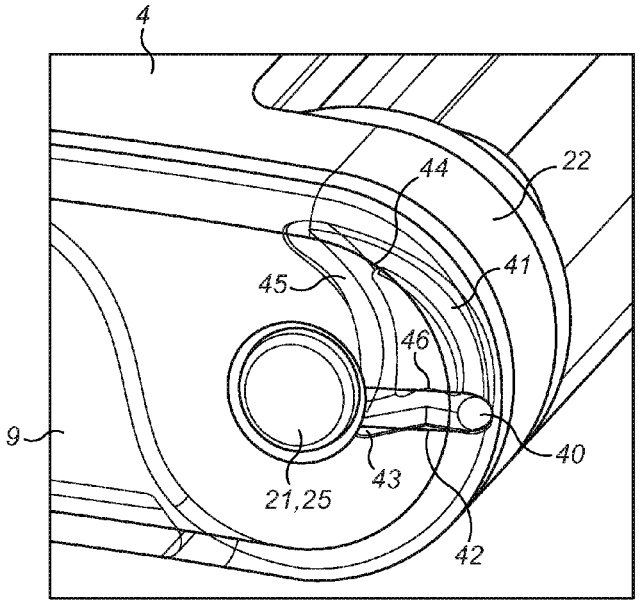
FIG. 7*b* shows a close-up view of the hinge of the container of FIGS. 4 to 6*c*, with the hinge in the position shown in FIG. 7*a*.
Figure 8A:
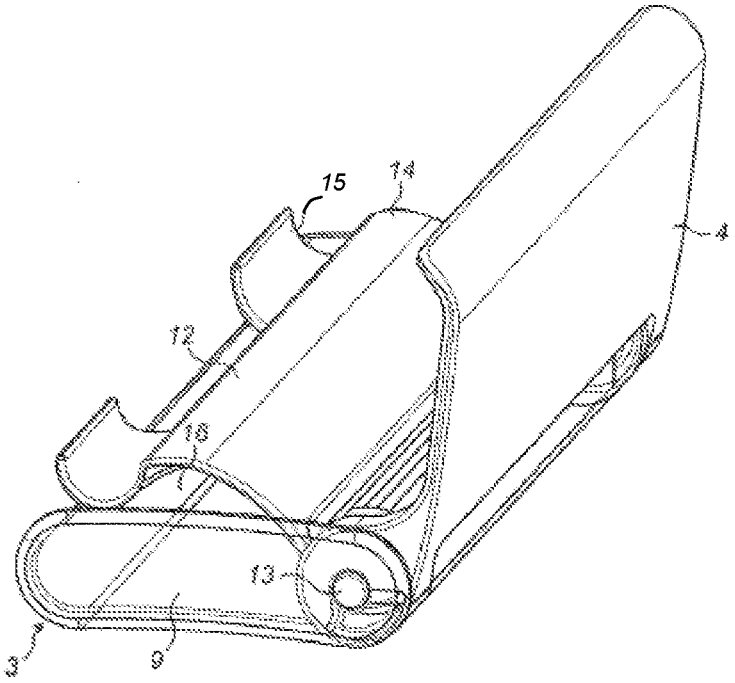
FIG. 8*a* shows the container of FIGS. 4 to 6*c*, with the lid in an open position.
Figure 8B:
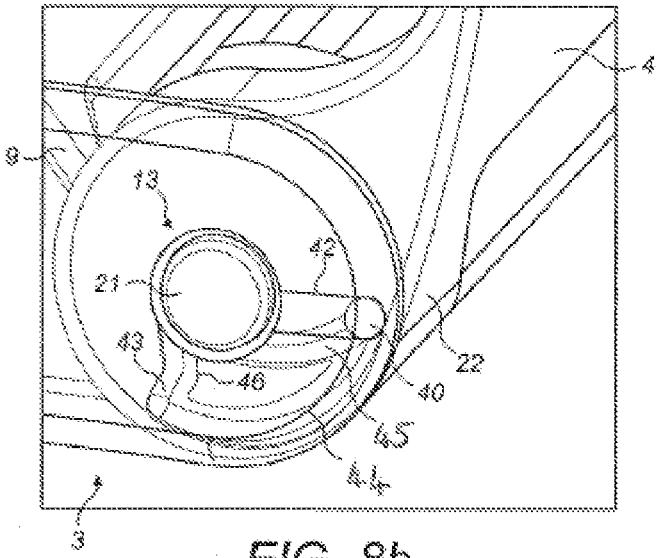
FIG. 8*b* shows a close-up view of the hinge of the container of FIGS. 4 to 6*c*, with the hinge in the open position shown in FIG. 8*a*.

FIG. 7*b* shows an enlarged view of an end of the container 1, showing the hinge components in more detail, when the lid 4 is in the position described with reference to FIG. 7*a*. As shown in FIG. 7*b*, by pushing down on the lid 4 the angle between the track 41 in the hinge member 22 and the groove 42 in the end wall 9 has caused the ball bearing 40 to move along the first portion 43 of the track 41 away from the bend 46 and the pin 21 and into the second portion 44 of the track 41. Therefore, the ball bearing 40 is now positioned at the end of the groove 42 in the end wall 9, remote from the pin 21, and in the join between the first portion 43 and the second portion 44 of the track 41. The ball bearing 40 is now in an unstable position and when the lid 4 is released by the user the biasing member 47 (see FIG. 5) rotates the lid 4 into the open position and the ball bearing 40 is moved along the second portion 44 of the track 41. Therefore, the lid 4 is able to rotate until the ball bearing 40 reaches the end of the second portion 44, where it joins the third portion 45 of the track 41, as shown in FIGS. 8*a* and 8*b*. In this position the lid 4 is prevented from further rotation and the lid 4 is held in the open position.

As shown in FIG. 8*a*, the lid 4 rotates to an open position in which the chamber 12 is accessible. In this example, the tray 14 is pivotally coupled to the lid 4, as described with reference to FIG. 5, and the tray 14 is shown in the raised position with the recessed region 15 on top of the tray 14 and the compartment 16 below the tray 14.

FIG. 8*b* shows an enlarged view of the hinge 13 of the container of FIG. 8*a*, in the open position, and shows the hinge components. As shown, the ball bearing 40 is now disposed at the join between the second portion 44 and third portion 45 of the track 41 in the hinge member 22 and the end of the groove 42 remote from the hinge pin 21. Therefore, the biasing member 47 (see FIG. 5) is pushing the ball bearing 40 into the join between the second and third portions 44, 45 of the track 41 which is a stable position and the lid 4 is at its maximum opening angle. The length of the second portion 44 of the track 41, the angle around the hinge member 22 which the second portion 44 of the track 41 extends, will define the open position of the lid 4.

When a user rotates the lid 4 back to the closed position the ball bearing 40 will move from the position shown in FIG. 8*b* into and along the third portion 45 of the track 41 in the hinge member 22 which also pushes the ball bearing 40 along the groove 42 in the end wall 9 towards the hinge pin 21. When the lid 4 is rotated past the closed position and is released the ball bearing 40 will re-enter the first portion 43 of the track 41 and the biasing member will push the ball bearing 40 back into the bend 46, which is the stable closed position shown in FIG. 6*b*.

Therefore, as described above, during opening and closing of the lid 4 the ball bearing 40 moves around a closed track 41 formed in the hinge member 22 of the lid 4 and a linear groove 42 formed in the end wall 9 of the body 3. The ball bearing 40, which is moved by a combination of the groove 42 in the end wall 9, the track 41 in the hinge member 22 and the biasing member 47, has two stable positions: a stable closed position is defined when the ball bearing 40 is disposed in the bend 46 of the first portion 43 of the track 41; and, a stable open position is defined when the ball bearing 40 is disposed at the join between the second and third portions 44, 45 of the track 41.

It will be appreciated that the track 41 and the groove 42 may be arranged differently to that described with reference to FIGS. 6*a* to 8*b*. For example, the groove 42 may be formed in the hinge member 22 of the lid and the track 41 may be formed in the end wall 9 of the body 3. Alternatively, the track 41 and groove 42 may be disposed on the other side of the hinge member 22, with one of the groove 42 or track 41 being formed in a part of the side wall 11 of the body 3. It will be also be appreciated that the groove 42 need not be disposed parallel to the base wall 7 of the container, as shown in FIGS. 6*a* to 8*b*, and may be disposed at any angle to the pin 21, with the position of the track 41 being adjusted accordingly.

It will be appreciated that the push-to-open/close locking mechanism described with reference to FIGS. 6*a* to 8*c* may be used on other example containers that do not have the partially rotating tray feature. The locking mechanism described with reference to FIGS. 6*a* to 8*b* may be used on any of the containers described with reference to the Figures.

The containers 1 described with reference to the Figures all hold an electronic nicotine delivery system 2 in a closed and secure manner, within a rigid and robust container, so that the item is protected whenever the electronic nicotine delivery system is not being used, for example when being carried, used, held, stored and during storage and sales display. The containers 1 described are easy to open and provide unimpeded access to any electronic nicotine delivery system 2 disposed within such a container 1, as well as providing space for ancillary articles, such as product information leaflets or spare parts. The smooth exterior of the containers 1 allows a user to easily put the container 1 in their pocket and extract it without any part of the container getting caught or stuck.

The containers described with reference to the drawings are made from a strong and durable material and provide protection against impacts, dropping, shaking and against damage caused by dirt, or grit and even at least partial protection against water and other liquids. Moreover, the closing action and the locking mechanisms of the containers are reliable and simple to use so a user is able to easily open and close the containers during use.

In order to address various issues and advance the art, the entirety of this disclosure shows by way of illustration various embodiments in which the claimed invention(s) may be practiced and provide for superior container for an electronic nicotine delivery system. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A container for an electronic nicotine delivery system, the container comprising:

a body having a pair of end walls spaced from each other by a base wall, the body including a recess extending between the end walls to receive an electronic nicotine delivery system; and a lid pivotally attached to the body for rotation between open and closed positions about an axis parallel to a longitudinal axis of an electronic nicotine delivery system received in said recess, wherein the body includes a compartment between the recess and the lid axis, the body and the lid being configured so that an electronic nicotine delivery system is retained in the recess when the lid is in its closed position with the lid covering the recess and said compartment.

2. The container of claim 1, comprising a biasing member to bias the lid towards an open position.

3. The container of claim 2, wherein the body includes a compartment between the recess and the lid axis, the body and the lid being configured so that an electronic nicotine delivery system is retained in the recess when the lid is in its closed position with the lid covering the recess and said compartment.

4. The container of claim 2, further comprising a locking mechanism to hold the lid in the closed position.

5. The container of claim 4, wherein the locking mechanism comprises a cooperating protrusion on the lid and a receiving part on a front edge of the body, said protrusion being received in said receiving part to lock the lid in the closed position.

6. The container of claim 5, comprising a hinge mechanism that pivotally mounts the lid to the body, the hinge mechanism being configured so that the lid can slide laterally in a direction parallel to the base wall of the body to disengage the protrusion from the receiving part and allow the lid to pivot into its open position.

7. The container of claim 6, wherein the hinge mechanism comprises an elongate slot in the lid and a hinge pin that extends from the body and into said slot to pivotally mount the lid to the body and allow the lid to slide laterally relative to the hinge pin received in said slot.

8. The container of claim 2, comprising a hinge mechanism that includes a cam element captured between the body and the lid and constrained to move within a groove formed in the body and a track formed in said lid, said track defining a stable position for the cam element so that the lid is held in a closed position by the cam element when said cam element is in said stable position, and an unstable position in which the lid is free to pivot into its open position when released, said cam element being moveable out of said stable position into said unstable position in response to rotation of the lid in a direction towards the body from its closed position.

9. The container of claim 8, wherein the track comprises an endless loop in the lid and the cam element moves from its stable position along a first portion of the track when the lid pivots into its open position and along a second portion of the track back to its stable position when the lid is pivoted back into its closed position.

10. The container of claim 9, wherein the track is configured so that the cam element moves back into said stable position when the lid is rotated towards the body beyond its closed position so that the lid is held in its closed position when the lid is released.

11. The container of claim 1, comprising a tray received in said body, said recess being formed in said tray.

12. The container of claim 11, wherein said compartment is also formed by said tray.

13. The container of claim 12, wherein the tray is an insert that locates within the chamber and is pivotally mounted to the body for rotation about an axis coaxial with the lid.

14. The container of claim 13, wherein the tray is shaped so that said compartment is disposed between the tray and the base wall of the body, said compartment being accessible when said tray has been rotated about said axis.

15. The container of claim 13, wherein said lid and the tray are configured so that the lid engages the tray during rotation of said lid so that the tray rotates about said axis together with the lid for part of the rotation of the lid between its open and closed positions.

16. The container of claim 1, with an electronic nicotine delivery system received in the recess in the body.

17. The container of claim 16, wherein said electronic nicotine delivery system is an electronic cigarette.

18. The container of claim 2, comprising a tray received in said body, said recess being formed in said tray.

* * * * *